US008037689B2

(12) United States Patent
Oskin et al.

(10) Patent No.: US 8,037,689 B2
(45) Date of Patent: Oct. 18, 2011

(54) TURBINE FUEL DELIVERY APPARATUS AND SYSTEM

(75) Inventors: Sergey Adolfovich Oskin, Moscow (RU); Mark Allan Hadley, Greenville, SC (US); Joel Meador Hall, Mauldin, SC (US); Sergey Konstantinovich Yerokhin, Moscow (RU); Sergey Anatolievich Meshkov, Moscow (RU)

(73) Assignee: General Electric Company, Schenectady, NY (US)

( * ) Notice: Subject to any disclaimer, the term of this patent is extended or adjusted under 35 U.S.C. 154(b) by 1025 days.

(21) Appl. No.: 11/842,603

(22) Filed: Aug. 21, 2007

(65) Prior Publication Data

US 2009/0049838 A1 Feb. 26, 2009

(51) Int. Cl.
*F02G 3/00* (2006.01)

(52) U.S. Cl. ..... 60/737; 60/748; 60/746

(58) Field of Classification Search ..... 60/737, 60/740, 746, 747, 734, 748
See application file for complete search history.

(56) References Cited

U.S. PATENT DOCUMENTS

| | | | | |
|---|---|---|---|---|
| 4,891,936 | A * | 1/1990 | Shekleton et al. | 60/804 |
| 5,479,781 | A * | 1/1996 | Fric et al. | 60/740 |
| 5,941,075 | A * | 8/1999 | Ansart et al. | 60/748 |
| 6,216,466 | B1 * | 4/2001 | Alkabie | 60/746 |
| 6,547,163 | B1 * | 4/2003 | Mansour et al. | 239/404 |
| 6,684,640 | B2 * | 2/2004 | McMillan et al. | 60/737 |
| 6,834,505 | B2 * | 12/2004 | Al-Roub et al. | 60/737 |
| 2002/0112480 | A1 | 8/2002 | McMillan | |
| 2003/0131600 | A1 * | 7/2003 | David et al. | 60/737 |

OTHER PUBLICATIONS

Raik C. Orbay, Pontus Eriksson, Magnus Genrup and Jens Klingmann, GT2007-27936, "Off-design Performance Investigation of a Low Calorific Value Gas Fired Generic Type Single-Shaft Gas Turbine," ASME Turbo Expo 2007: Power for Land, Sea and Air, May 14-17, 2007, Montreal Canada.

Fedrico Bonzani, GT2006-90761, Syngas Burner Optimisation for Fuelling a Heavy Duty Gas Turbine with Various Syngas Blends, ASME Turbo Expo 2006: Power for Land, Sea and Air, May 8-11, 2006, Barcelona, Spain.

Federico Bonzani and Paolo Gobbo, GT2006-90760, "Development of a Heavy Duty GT Syngas Burner for IGCC Power Plant in Order to Enlarge the GT Operating Conditions," ASME Turbo Expo 2006: Power for Land, Sea and Air, May 8-11, 2006, Barcelona, Spain.

Chinese Office Action issued in connection with corresponding CN Application No. 200810213641.X, Mar. 9, 2011, with English translation.

* cited by examiner

*Primary Examiner* — Ehud Gartenberg
*Assistant Examiner* — Young Choi
(74) *Attorney, Agent, or Firm* — Cantor Colburn LLP

(57) ABSTRACT

A fuel nozzle for a turbine is disclosed. The fuel nozzle includes a housing, a plurality of fuel passages disposed within the housing, and a plurality of air passages disposed within the housing. A total flow area of the plurality of fuel passages is substantially equal to a total flow area of the plurality of air passages.

21 Claims, 5 Drawing Sheets

TURBINE FUEL DELIVERY APPARATUS AND SYSTEM

BACKGROUND OF THE INVENTION

The present disclosure relates generally to turbine engines, and particularly to turbine engine fuel delivery.

With increasing demands for natural gas, there is increased interest in the use of low heating value (LHV) fuels, including syngas and waste process gasses, such as blast furnace gasses produced as a byproduct of steel making that include remaining energy or flammability, for example. Typically, such remaining energy within waste process gasses is burnt off to reduce a likelihood of concentration and flammability concerns. Recovery and utilization of the remaining energy within waste process gasses includes use as a fuel for gas turbine engines, which may then provide electrical or mechanical power.

Such waste process gasses typically contain about one-tenth the thermal energy (such as British thermal units (BTU's) for example) of typical high heating value (HHV) gasses, such as natural gas for example. Therefore a greater ratio of fuel to air is required when operating a turbine on LHV waste process gas. Typical approaches to the large flows of LHV fuel that result from increased fuel to air ratios include injection of air accompanying the LHV gas into a liner of a combustion chamber of the turbine where the fuel and air are mixed before ignition.

The large flows of LHV gasses and their reduced thermal energy gasses can result in ineffective mixing of fuel and air, which thereby provides reduced combustion flame stability and a probability that the flame will blow out, resulting in an interruption of energy provided by the turbine. One approach to avoid such flame blowouts and service interruptions is a combination of HHV gasses with the LHV gasses to sustain turbine operation. However, because of availability and cost concerns, it is generally desired to reduce consumption of such HHV gasses. Accordingly, there is a need in the art for a turbine engine fuel delivery arrangement that overcomes these drawbacks.

BRIEF DESCRIPTION OF THE INVENTION

An embodiment of the invention includes a fuel nozzle for a turbine. The fuel nozzle includes a housing, a plurality of fuel passages disposed within the housing, and a plurality of air passages disposed within the housing. A total flow area of the plurality of fuel passages is substantially equal to a total flow area of the plurality of air passages.

Another embodiment of the invention includes a combustor for a turbine. The combustor includes an outer liner and an inner liner defining a combustion chamber therebetween, and a plurality of fuel nozzles in fluid communication with the combustion chamber. Each fuel nozzle of the plurality of fuel nozzles includes a housing, and a plurality of fuel passages and air passages disposed within the housing. A total flow area of the plurality of fuel passages is substantially equal to a total flow area of the plurality of air passages.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a turbine engine fuel nozzle having air passages and fuel passages with substantially equal flow area to provide a substantially one to one ratio of LHV fuel to air. In an embodiment, the air passages and fuel passages are disposed proximate one another and define a helical flow path to initiate mixing of air and fuel proximate an outlet of the nozzle, thereby increasing the quality of mixing of the LHV fuel and air within a liner of a combustion chamber of the turbine engine. The increased quality of mixing reduces likelihood of flame blowout and a need to introduce HHV fuel into the turbine for stable operation.

Figure 1:
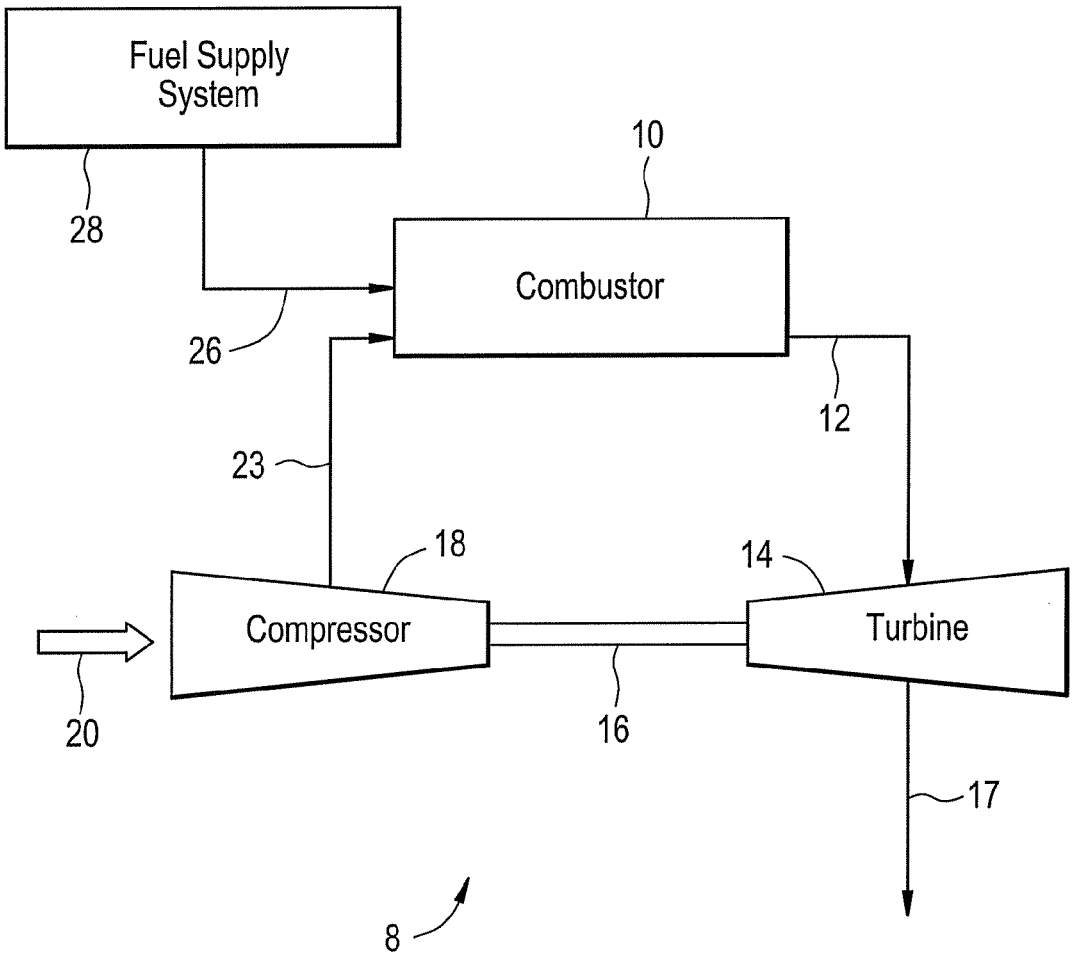
FIG. 1 depicts a schematic drawing of a turbine engine in accordance with an embodiment of the invention.

FIG. 1 depicts a schematic drawing of an embodiment of a turbine engine 8, such as a gas turbine engine 8. The gas turbine engine 8 includes a combustor 10. Combustor 10 burns a fuel-oxidant mixture to produce a flow of gas 12 which is hot and energetic. The flow of gas 12 from the combustor 10 then travels to a turbine 14. The turbine 14 includes an assembly of turbine blades (not shown). The flow of gas 12 imparts energy on the assembly of turbine blades causing the assembly of turbine blades to rotate. The assembly of turbine blades is coupled to a shaft 16. The shaft 16 rotates in response to a rotation of the assembly of turbine blades. The shaft 16 is then used to power a compressor 18. The shaft 16 can optionally provide a power output 17 to a different output device (not shown), such as, for example, an electrical generator. The compressor 18 takes in and compresses an oxidant stream 20. Following compression of the oxidant stream 20, a compressed oxidant stream 23 is fed into the combustor 10. The compressed oxidant stream 23 from the compressor 18 is mixed with a fuel flow 26 from a fuel supply system 28 to form the fuel-oxidant mixture inside the combustor 10. The fuel-oxidant mixture then undergoes a burning process in the combustor 10.

Figure 2:
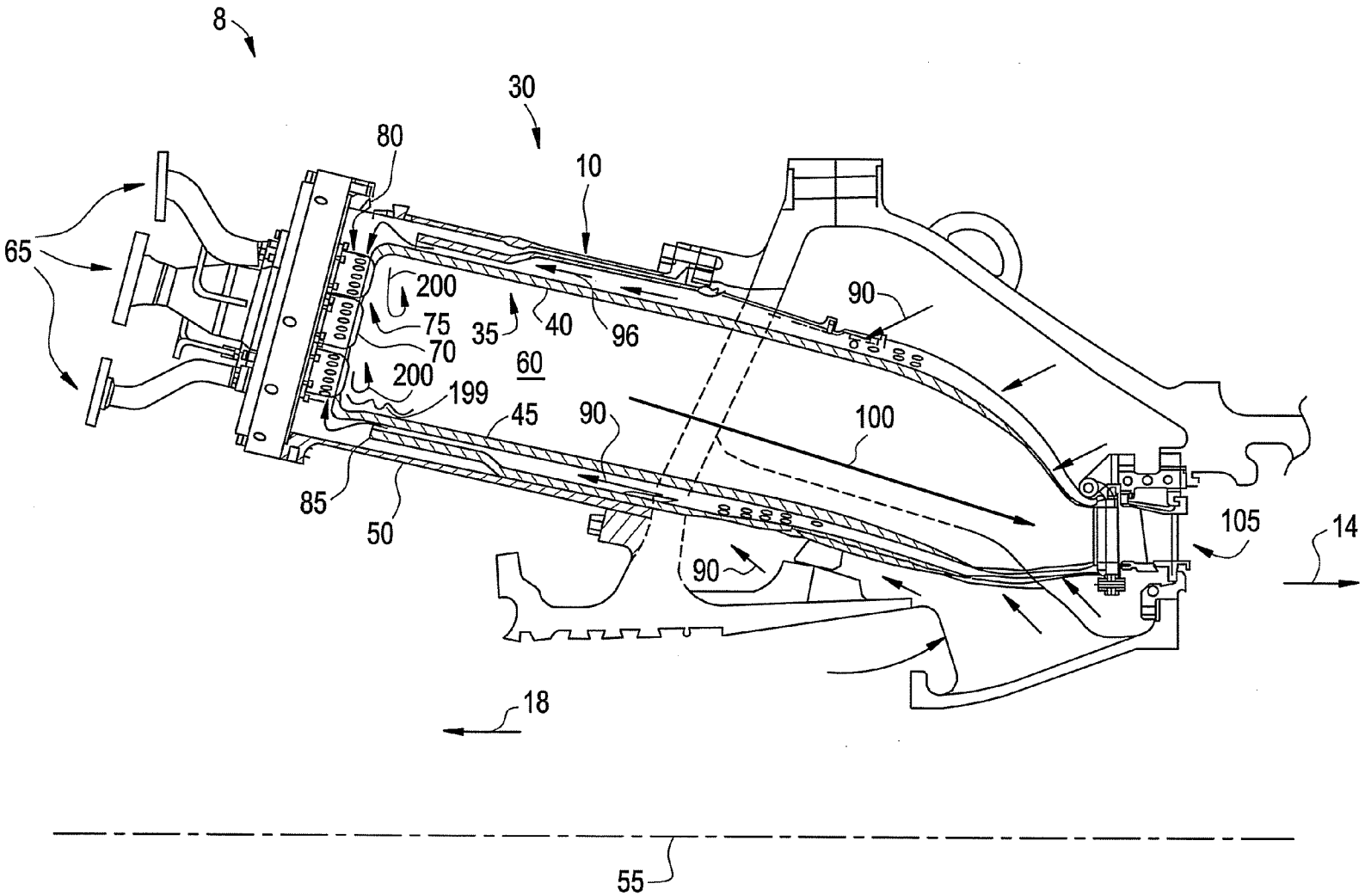
FIG. 2 depicts a combustion section of a turbine engine in accordance with an embodiment of the invention.

Referring now to FIG. 2, a portion of the gas turbine engine 8 having a combustion section 30 located downstream from the compressor 18 and upstream from the turbine 14 is depicted.

The combustion section 30 includes the combustor 10 that includes an outer liner 40 and an inner liner 45 disposed within a combustion casing 50. The outer and inner liners 40 and 45 are generally annular in form about an engine centerline axis 55 and are radially spaced from each other to define a combustion chamber 60 therebetween. One or more fuel supply lines 65 direct fuel to a plurality of fuel nozzles 70 that each include an outlet 75 in fluid communication with the combustion chamber 60. The fuel nozzles 70 are disposed within a cowl assembly 80 mounted to the upstream ends of the outer and inner liners 40 and 45. A flowsleeve 85 disposed between the combustion casing 50 and the outer and inner liners 40, 45 of the combustor 10 directs compressed air (indicated generally by arrows 90) provided by the compressor 18 toward the cowl assembly 80.

The compressed air passes through a plurality of air inlets 95 (best seen with reference to FIG. 3) of the fuel nozzles 70. As will be described further below, the fuel nozzles 70 include passages (to be shown and described below) that combine the compressed air 90 with fuel, such as the LHV fuel, provided by the fuel supply lines 65 for combustion within the combustion chamber 60. The burning air-fuel mixture (indicated by arrow 100) leaves the combustion chamber 60 via exit 105, and enters the turbine 14 of the engine 8 for conversion of thermal expansion into turbine blade rotation as described above.

It is noted that although FIG. 2 illustrates a single annular combustor as an exemplary embodiment, the present invention is equally applicable to other types of combustors, such as double annular combustors for example.

Figure 3:
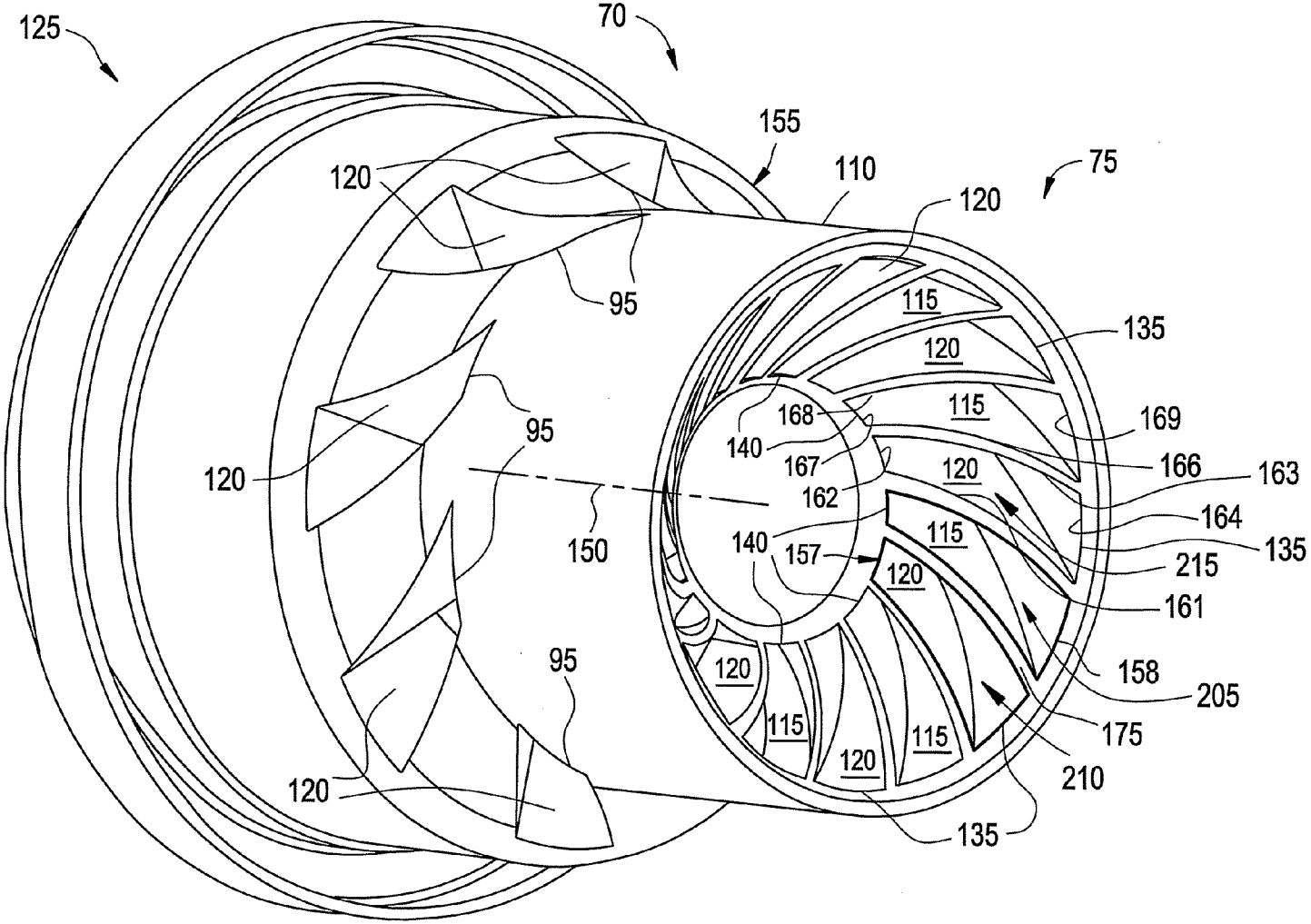
FIG. 3 depicts an upstream end perspective view of a fuel nozzle in accordance with an embodiment of the invention.

FIG. 3 depicts an upstream end perspective view of an exemplary embodiment of the fuel nozzle 70. The nozzle 70 includes an inlet 125 and a housing 110 having a plurality of fuel passages 115 and air passages 120 that are disposed circumferentially within the housing 110 surrounding a central axis 150. The air passages 120 are in fluid communication with the combustion chamber 60 and include air inlets 95 and air outlets 135. Fuel passages 115 are in fluid communication with the combustion chamber 60 and include fuel outlets 140 and fuel inlets 145 (not visible in FIG. 3).

Figure 4:
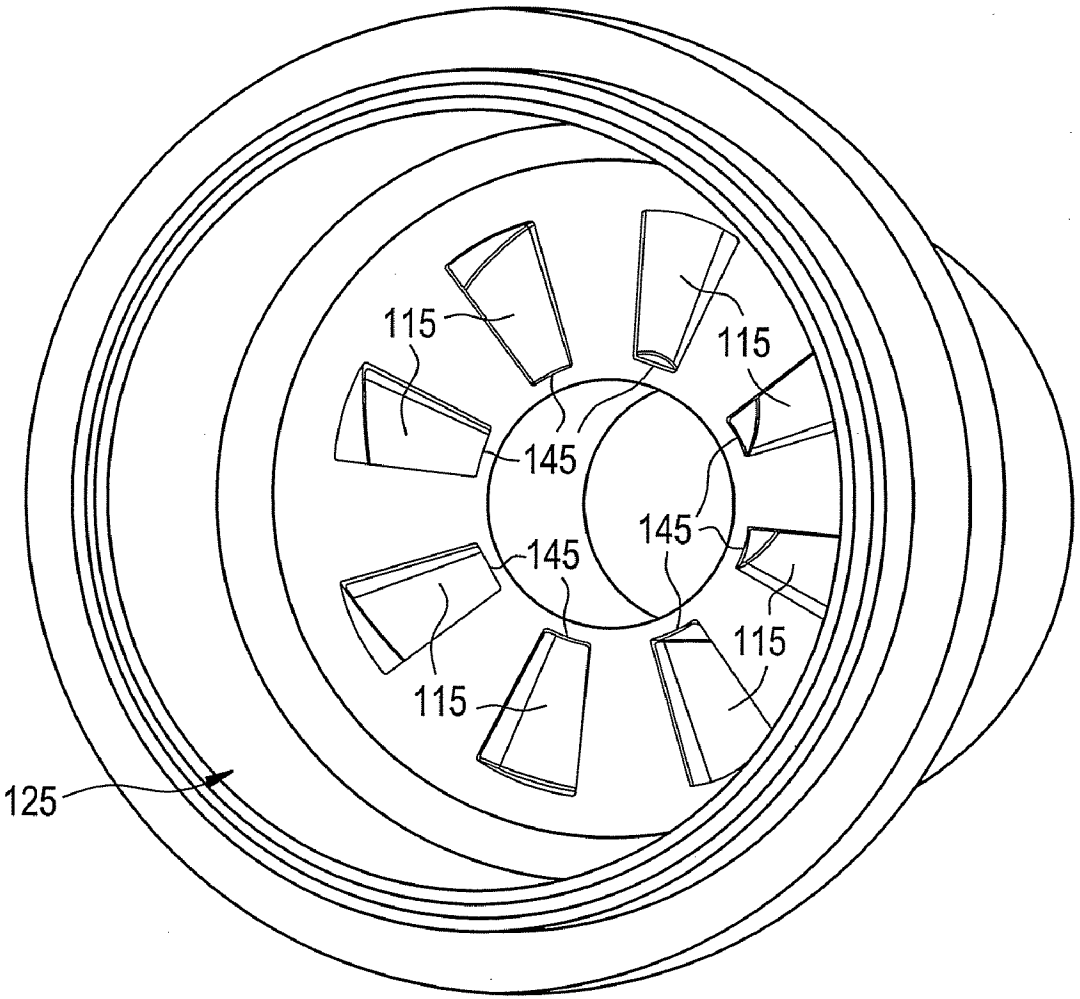
FIG. 4 depicts a downstream end perspective view of the fuel nozzle depicted in FIG. 3 in accordance with an embodiment of the invention.

FIG. 4 depicts a downstream end perspective view of the embodiment of the fuel nozzle 70 shown in FIG. 3, including the fuel inlets 145 of the fuel passages 115. In an embodiment, as depicted in FIGS. 3 and 4, the fuel passages 115 are axial passages including fuel inlets 145 disposed within the inlet 125 of the nozzle 70 and fuel outlets 140 disposed within the outlet 75 of the nozzle, the axial fuel passages 115 are generally aligned with the central axis 150 which is oriented from a center of the inlet 125 toward a center of the outlet 75 of the nozzle 70. In an embodiment the air inlets 95 are radial air inlets 95, and are disposed on an exterior surface 155 of the housing 110.

Turbine engines that are configured to utilize standard HHV fuels, such as natural gas for example, typically operate with fuel-to-air ratios that may range from approximately 0.001 to approximately 0.01. Accordingly, engines that operate using HHV fuels may incorporate nozzles having ratios of flow area of fuel passages to flow area of air passages of approximately 0.001. As described above, in order to operate on LHV fuels, the total fuel flow must be significantly increased for a given engine output. The increase in fuel flow includes a corresponding increase in the ratio of fuel to air to approximately 1 to 1. Because of the high fuel flow relative to previous nozzle geometry designs, current approaches to such increases in the flow of fuel and air have been to separately inject the fuel and the air into the combustion chamber, with observed fuel and air mixing difficulties that result in flame blowout. Size restrictions, particularly within existing designs of the combustion components using circular nozzle passages often preclude adjacent placement of fuel and air steams such that separate, direct injection is necessary. An embodiment such as that depicted in FIG. 3 overcomes this difficulty by delivering enhanced space consumption within the upstream region of the combustion chamber 60.

A cross-sectional area of an opening of the passage 115, 120 that defines a maximum amount of fluid at a given pressure that may flow through the passage 115, 120 is also known as the flow area of the passage 115, 120. In an embodiment, and for purposes of illustration, the flow area of the passage 115, 120 may be defined by the area of the outlet 135, 140 of the passage 115, 120. Therefore, in order to provide the increase in ratio of fuel to air to approximately 1 to 1 through the nozzle 70 for LHV fuel use, a total area of the air outlets 135 is substantially equal to a total area of the fuel outlets 140. For example, an area 157 of an air outlet 135 defines an amount of air capable of flowing through the outlet 135, and thereby defines a flow area 157 of the air passage 120. Similarly, an area 158 of a fuel outlet 140 defines an amount of air capable of flowing through the outlet 140, and thereby defines a flow area 158 of the fuel passage 115. Therefore a total of flow areas 158 of the fuel passages 115, defined by a sum of the areas 158 of the outlets 140 of the plurality of fuel passages 115, is substantially equal to a total of flow areas 157 of the air passages 120, defined by sum of the areas 157 of the outlets 135 of the plurality of air passages 120. In one embodiment, a flow area 158 of each outlet 140 of each fuel passage 115 is substantially equal to a flow area 157 of each outlet 135 of each air passage 120.

While an embodiment of the invention has been described defining the flow area 157, 158 of a passage 115, 120 as the area of the outlet 135, 140, it will be appreciated that the scope of the invention is not so limited, and that the invention will also apply to nozzles 70 in which the flow area 157, 158 may be defined by any given cross-sectional area of the opening of the passage 115, 120 which thereby defines a maximum fluid flow that the passage 115, 120 is capable of flowing at a given pressure.

Furthermore, in order to accommodate the increase in flow of fuel within the combustion chamber 60 having a given size that utilizes nozzles 70 having the housing 110 of a given size, it is necessary to develop new passage 115, 120 geometry for increasing the area of the fuel passages 115 within the given nozzle 70 housing 110 size. In an embodiment, the air outlets 135 and the fuel outlets 140 each respectively include four sides (161, 162, 163, 164 and 166, 167, 168, 169). Use of outlets 135, 140 having four sides 161-169 reduces an area of non-passage portions of the nozzle 70, such as may be used for nozzle 70 structure, such as dividers 175 disposed between the outlets 135, 140 for example. Therefore, use of the passages 115, 120 having four sides 161-169 increases a flow area within a given nozzle 70 housing 110 size.

Figure 5:
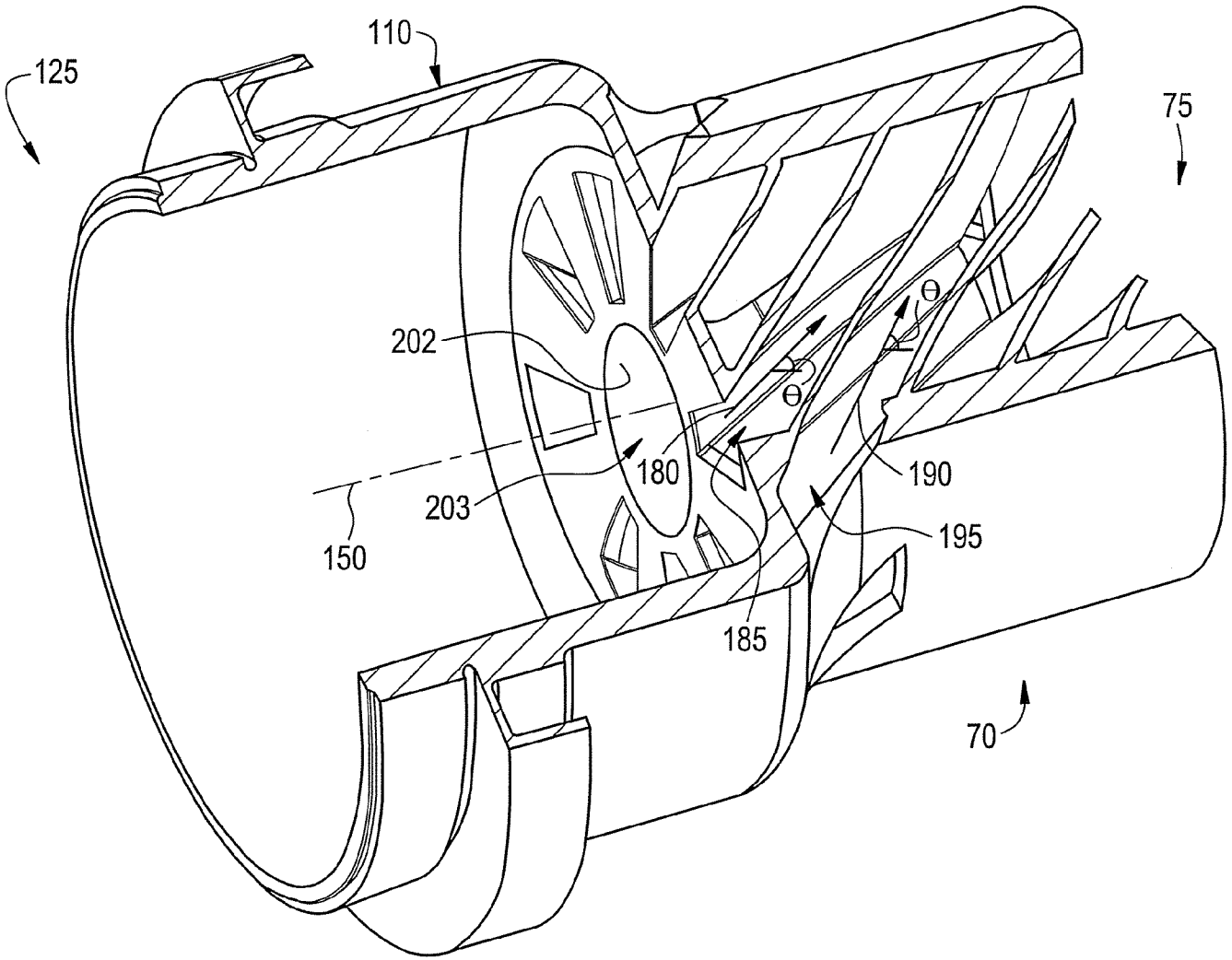
FIG. 5 depicts a partial section view of the fuel nozzle in accordance with an embodiment of the invention.

FIG. 5 depicts a partial section view of the nozzle 70. A fuel flow path 180 defined by a fuel passage 185 and an air flow path 190 defined by an air passage 195 through the nozzle 70 are visible. In an embodiment, the passages 185, 195 defining the flow paths 180, 190 include an angle θ relative to the central axis 150, such that the passages 185, 195 are helical passages 185, 195, thereby defining helical flow paths 180, 190. Because of the mass associated with the fuel and air flowing through the helical flow paths 180, 190, the fuel and air that flow through the nozzle 70 will swirl after they exit the nozzle outlet 75. The swirling outside the exit 75 of the fuel and air that flow through the nozzle 70 results in a recirculation zone 199 proximate the outlet 75. The recirculation zone 199 results in a slower progression of the air and fuel from the outlet 75 of the nozzle 70 toward the exit 105 of the combustion chamber 60, thereby increasing the quality of mixture of fuel and air within the combustion chamber 60 (best seen with reference to FIG. 2). Reference number 200 schematically depicts the presence of the swirling air and fuel within the recirculation zone 199 outside the outlet 75 of the nozzle 70. In an embodiment, each fuel flow path 180 defined by the plurality of fuel passages 115 includes a helical fuel flow path 180 and each air flow path 190 defined by the plurality of air passages 120 includes a helical air flow path 190, increasing the quality of mixture of the fuel and air in the recirculation zone 199 proximate the outlet 75 of the nozzle 70.

In an embodiment, the housing 110 includes a surface 202 that defines a bore 203 passing through the nozzle 70. The bore 203 is in fluid communication with the combustion chamber 60. In one embodiment the bore 203 accommodates an additional fuel injector (not shown) that is utilized to provide an injection of HHV fuel, such as natural gas or diesel oil for starting of the engine 8, prior to a transfer to use of the LHV fuel. In another embodiment, the bore 203 accommodates an electrical spark igniter that is contemplated for starting the engine 8 to begin operation with the LHV fuel, such syngas or waste process gasses, for example.

Referring back to FIG. 3, disposal of the fuel passages 115 in close proximity to the air passages 120 at the outlet 75 further enhances the quality of mixture of air and fuel provided by the swirling flow paths 180, 190 as described above. It is contemplated that an arrangement including adjacent disposal of alternating fuel and air passages 115, 120 enhances mixing of fuel and air. As described above, the plurality of fuel passages 115 are disposed circumferentially within the housing 110 surrounding the central axis 150 and the plurality of air passages 120 are likewise disposed circumferentially within the housing 110 surrounding the central axis 150. In an embodiment, at least one fuel passage 115 of the plurality of fuel passages 115, such as fuel passage 205 for example, is disposed between two consecutive air passages 120 of the plurality of air passages 120, such as air passages 210 and 215 for example. In a further embodiment, each fuel passage 115 of the plurality of fuel passages 115 is disposed adjacent to and between two air passages 120 of the plurality of air passages 120. In another embodiment, each air passage 120 of the plurality of air passages 120 is disposed adjacent to and between two fuel passages 115 of the plurality of fuel passages 115, which thereby provides the fuel passages 115 and air passages 120 having the adjacent, alternating arrangement of air passages 120 and fuel passages 115 to enhance the quality of mixing of the air and fuel.

The enhanced quality of mixing of air and fuel provided by the adjacent, alternating arrangement of air passages 120 and fuel passages 115 is contemplated to increase an efficiency of operation of the engine 8. Further, an enhanced time of recirculation within the recirculation zone 199 is contemplated to reduce a likelihood of a blowout of the flame of combustion of the fuel and air mixture.

While an embodiment of the invention has been described having fuel and air passages 115, 120 including four sides 161-169, it will be appreciated that the scope of the invention is not so limited, and that the invention also applies to nozzles 70 having fuel and air passages 115, 120 that may include other geometry to increase passage 115, 120 size within the nozzle housing 110, such as more than 4 sides, elliptical, oval, and curvilinear geometry, for example.

As disclosed, some embodiments of the invention may include some of the following advantages: an enhanced quality of mixing of air and LHV fuel within a turbine combustion chamber; increased efficiency of LHV fuel turbine operation from the enhanced mixing quality; reduced flame blowout providing increased reliability of LHV fuel turbine operation; and use of turbine combustion chambers and fuel nozzles for LHV fuel that have dimensions associated with HHV fuel use.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A fuel nozzle for a turbine, the fuel nozzle comprising:

a housing;

a plurality of fuel passages disposed within the housing, each fuel passage having an opening, whereby fuel flows through each of the fuel passages and each of the respective openings in predominantly axial and circumferential directions; and a plurality of air passages disposed within the housing, each air passage having an opening, whereby air flows through each of the air passages and each of the respective openings in predominantly axial and circumferential directions, wherein each fuel passage of the plurality of fuel passages is disposed between two consecutive air passages of the plurality of air passages, and wherein a total flow area of the plurality of fuel passages is substantially equal to a total flow area of the plurality of air passages.

2. The fuel nozzle of claim 1, wherein:

a flow area of each fuel passage of the plurality of fuel passages is substantially equal to a flow area of each air passage of the plurality of air passages.

3. The fuel nozzle of claim 1, wherein:

at least one of a fuel passage of the plurality of fuel passages and an air passage of the plurality of air passages comprises four sides.

4. The fuel nozzle of claim 3, wherein:

each fuel passage of the plurality of fuel passages and each air passage of the plurality of air passages comprise four sides.

5. The fuel nozzle of claim 1, wherein the turbine further comprises a combustion chamber and wherein:

the plurality of fuel passages are disposed circumferentially within the housing, each fuel passage of the plurality of fuel passages being in fluid communication with the combustion chamber; and the plurality of air passages are disposed circumferentially within the housing, each air passage of the plurality of air passages being in fluid communication with the combustion chamber, a fuel passage of the plurality of fuel passages being disposed between two consecutive air passages of the plurality of air passages.

6. The fuel nozzle of claim 5, wherein:

each fuel passage of the plurality of fuel passages is disposed adjacent to and between two air passages of the plurality of air passages.

7. The fuel nozzle of claim 6, wherein:

each air passage of the plurality of air passages is disposed adjacent to and between two fuel passages of the plurality of fuel passages, thereby providing an adjacent alternating arrangement of each air passage of the plurality of air passages and each fuel passage of the plurality of fuel passages.

8. The fuel nozzle of claim 5, wherein:

the housing comprises a surface defining a bore passing through the nozzle, the bore being in fluid communication with the combustion chamber.

9. The fuel nozzle of claim 1, wherein:

a fuel passage of the plurality of fuel passages comprises a helical fuel passage; and an air passage of the plurality of air passages comprises helical air passage.

10. The fuel nozzle of claim 1, wherein air enters each of the plurality of the air passages with an inward radial flow component and is then directed to flow axially within each of the plurality of the air passages.

11. The fuel nozzle of claim 9, wherein:

each fuel passage of the plurality of fuel passages comprises the helical fuel passage; and each air passage of the plurality of air passages comprises the helical air flow path.

12. A combustor for a turbine, the combustor comprising:

an outer liner and an inner liner defining a combustion chamber therebetween; and a plurality of fuel nozzles in fluid communication with the combustion chamber;

wherein each fuel nozzle of the plurality of fuel nozzles comprises:

a housing;

a plurality of fuel passages disposed within the housing, each fuel passage having an opening, whereby fuel flows through each of the fuel passages and each of the respective openings in predominantly axial and circumferential directions; and a plurality of air passages disposed within the housing, each air passage having an opening, whereby air flows through each of the air passages and each of the respective openings in predominantly axial and circumferential directions, wherein each fuel passage of the plurality of fuel passages is disposed between two consecutive air passages of the plurality of air passages, and wherein a total flow area of the plurality of fuel passages is substantially equal to a total flow area of the plurality of air passages.

13. The combustor of claim 12, wherein:

at least one of a fuel passage of the plurality of fuel passages and an air passage of the plurality of air passages comprise four sides.

14. The combustor of claim 12, wherein:

the plurality of fuel passages are disposed circumferentially within the housing, each fuel passage of the plurality of fuel passages being in fluid communication with the combustion chamber; and the plurality of air passages are disposed circumferentially within the housing, each air passage of the plurality of air passages being in fluid communication with the combustion chamber, a fuel passage of the plurality of fuel passages being disposed between two consecutive air passages of the plurality of air passages.

15. The combustor of claim 14, wherein:

each fuel passage of the plurality of fuel passages is disposed adjacent to and between two air passages of the plurality of air passages.

16. The combustor of claim 15, wherein:

each air passage of the plurality of air passages is disposed adjacent to and between two fuel passages of the plurality of fuel passages, thereby providing an adjacent alternating arrangement.

17. The combustor of claim 12, wherein:

a fuel passage of the plurality of fuel passages comprises a helical fuel passage; and an air passage of the plurality of air passages comprises a helical air passage.

18. The combustor of claim 17, wherein:

each fuel passage of the plurality of fuel passages comprises the helical fuel passage; and each air passage of the plurality of air flow passages comprises the helical air passage.

19. A fuel nozzle for a turbine, the fuel nozzle comprising:

a housing;

a plurality of fuel passages disposed circumferentially within the housing, each fuel passage having an opening, whereby fuel flows through each of the fuel passages and each of the respective openings in predominantly axial and circumferential directions; and a plurality of air passages disposed circumferentially within the housing, each air passage having an opening, whereby air flows through each of the air passages and each of the respective openings in predominantly axial and circumferential directions, wherein a total flow area of the plurality of fuel passages is substantially equal to a total flow area of the plurality of air passages, wherein each fuel passage of the plurality of fuel passages is disposed between two consecutive air passages of the plurality of air passages; and wherein each air passage of the plurality of air passages is disposed adjacent to and between two fuel passages of the plurality of fuel passages, thereby providing an adjacent alternating arrangement of each air passage of the plurality of air passages and each fuel passage of the plurality of fuel passages.

20. The fuel nozzle of claim 19, wherein:

a fuel passage of the plurality of fuel passages comprises a helical fuel passage; and an air passage of the plurality of air passages comprising a helical air passage.

21. The fuel nozzle of claim 20, wherein:

each fuel passage of the plurality of fuel passages comprises the helical fuel passage; and each air passage of the plurality of air passages comprises the helical air passage.

* * * * *